US007780454B2

(12) United States Patent
Baranski

(10) Patent No.: US 7,780,454 B2
(45) Date of Patent: Aug. 24, 2010

(54) RETAINING SOCKET

(75) Inventor: Detlef Baranski, Recklinghausen (DE)

(73) Assignee: Pilkington Automotive Deutschland GmbH, Witten (DE)

( * ) Notice: Subject to any disclaimer, the term of this patent is extended or adjusted under 35 U.S.C. 154(b) by 333 days.

(21) Appl. No.: 11/795,817

(22) PCT Filed: Jan. 23, 2006

(86) PCT No.: PCT/EP2006/000551

§ 371 (c)(1),
(2), (4) Date: Jul. 23, 2007

(87) PCT Pub. No.: WO2006/077149

PCT Pub. Date: Jul. 27, 2006

(65) Prior Publication Data

US 2008/0272260 A1 Nov. 6, 2008

(30) Foreign Application Priority Data

Jan. 24, 2005 (DE) ..... 10 2005 003 386

(51) Int. Cl.
*H01R 33/00* (2006.01)

(52) U.S. Cl. ..... 439/34

(58) Field of Classification Search ..... 439/34, 439/916, 917, 342, 345, 67, 61; 361/737, 361/752, 807; 248/314; 219/203
See application file for complete search history.

(56) References Cited

U.S. PATENT DOCUMENTS 5,035,635 A 7/1991 Tsai et al.
5,595,498 A 1/1997 Jego et al.
5,676,562 A 10/1997 Fukuda et al.
6,234,820 B1 5/2001 Perino et al.
6,411,259 B1 6/2002 Wendt
6,704,204 B1 3/2004 Eskildsen et al.

FOREIGN PATENT DOCUMENTS

| | | | |
|---|---|---|---|
| DE | 73 42 862 | U1 | 3/1974 |
| DE | 196 33 933 | A1 | 4/1998 |
| DE | 198 23 202 | C2 | 12/1999 |
| DE | 102 11 444 | A1 | 10/2003 |
| EP | 0 506 451 | A | 9/1992 |
| EP | 0 978 909 | A | 2/2000 |
| GB | 1 387 906 | A | 3/1975 |
| GB | 1 453 470 | A | 10/1976 |
| WO | 99/21206 | A1 | 4/1999 |
| WO | 2004/034510 | A1 | 4/2004 |

OTHER PUBLICATIONS

International Search Report dated Apr. 11, 2006 and International Preliminary Report on Patentability dated May 8, 2007.

*Primary Examiner*—Alexander Gilman
(74) *Attorney, Agent, or Firm*—Buchanan Ingersoll & Rooney PC

(57) ABSTRACT

A retaining socket which allows detachable fixing of built-in parts of various kinds with various directions of movement during the fitting to glass panes comprises a base part, optionally serving to glue or otherwise fix the retaining socket to the glass pane, at least one first accommodation space for accommodating a retaining portion of a built-in part introduceable in the direction of movement perpendicular to the base part, and at least one second accommodation space for accommodating a retaining portion of a built-in part introduceable in the direction of movement parallel to the base part.

28 Claims, 8 Drawing Sheets

RETAINING SOCKET

BACKGROUND

The invention relates to glass panes, in particular automotive glass panes, with built-in components detachably fixed thereto with the aid of retaining sockets, and to retaining sockets for the same.

Glass panes and in particular automotive glass panes are being equipped with an ever-increasing diversity of functions, which as a rule are made available by means of built-in parts connected permanently or detachably to the glass pane. Several examples of such functions are the reception and transmission of electromagnetic signals with the aid of antennas for frequency ranges in the kHz range up to the GHz range, the detection of ambient conditions or of signals with the aid of sensors such as rain, temperature or light sensors, the emission of light with the aid of brake or signal lights, the use of glass panes as carriers of devices such as mirrors using mirror bosses, and many more. The built-in parts to be affixed in this regard to the glass panes comprise elements such as, for example, antennas, electronic components such as for example antenna amplifiers, terminals or connectors, brake lights in the form of individual lights or light clusters, optical or electrical rain sensors and many others.

In some cases, the built-in parts are not only to be mechanically connected to the glass pane, but in addition an electrical connection is to be produced with contacting points of functional elements such as antennas, heating elements or suchlike integrated into the glass pane or connected thereto, said contacting points being disposed on or in the glass pane.

The mechanical connection of built-in parts to glass panes takes place in practice, for example, by means of techniques such as gluing, clamping, moulding-on, soldering, welding. Drawbacks of such connecting techniques, which as a rule are permanent and undetachable, are, amongst others, the costly production of the mechanical connection, which on account of the application-specific character frequently cannot be automated or can be so only with large investment outlay, as well as a high outlay in the event of any repairs.

For the electrical connection of built-in parts with contacting points on/in the glass pane, use is usually made of soldering techniques, but also electrically conductive adhesives. It has also been proposed to press electrical contacts of built-in parts using elastic prestressing against assigned contacting points on the glass pane and thus to provide an electrical contact (amongst others, WO 2004/034510 A1).

It is common, especially for the detachable fixing of built-in parts such as interior mirrors or rain sensors on windscreens of motor vehicles, firstly to glue a retaining socket to the glass pane and then, at the latest after the installation of the glass pane in the motor vehicle, to connect the built-in part mechanically to the retaining socket and thereby to fix it to the glass pane (e.g. WO 99/21206 A1).

The use of a retaining socket has also already been proposed for the fixing of high-frequency devices, i.e. antenna amplifiers or antenna matching circuits. DE 198 23 202 C2 discloses a frame-like retaining socket for the detachable accommodation of one such high-frequency device. The frame-like retaining socket surrounds a plurality of contacting points of antenna conductors printed on the glass pane. It has, in the flat strip-like frame legs, projections pointing towards the frame interior, under which projections there can be pushed lugs provided at the edge of the high-frequency device to be accommodated by the retaining socket, as a result of which the high-frequency device is pressed against the glass pane in the accommodation space formed by the frame-like arrangement and is fixed thereto. The projections are designed either as guide rails disposed on three sides, which permit the high-frequency device to be pushed into the accommodation space parallel to the surface of the glass pane, or they are perforated. In the latter case, the high-frequency device is first introduced perpendicular to the glass pane into the accommodation space of the frame-like retaining socket and then pushed slightly to the side in the latter for the purpose of fixing. The high frequency device is equipped with spring contacts, which at the same time as the fixing of the high-frequency device make contact in a detachable manner with the contacting points on the glass pane inside the frame-like retaining socket. The previously known retaining socket is intended solely for the fixing of built-in parts such as antenna amplifiers to glass panes and is designed comparatively complex and costly, and on the other hand offers little flexibility of use.

Other technologies also consider the use of retaining sockets. For example, U.S. Pat. No. 6,704,204 discloses a casing for an IC card, where an IC package is inserted into a casing having two accommodation spaces. U.S. Pat. No. 5,035,635 discloses a revolving safety socket, wherein the retaining socket into which a plug is inserted is able to rotate between electrical contacts. U.S. Pat. No. 5,595,498 discloses a plug connector for electrical trunking, where the plug is inserted into a retaining socket having more than one accommodation space. However, none of these documents describe technologies suitable for fixing built-in parts to a glass pane.

The problem underlying the invention is to provide an improved retaining socket, which makes it possible to fix built-in parts of various kinds with various directions of movement during the fitting to glass panes. The retaining socket should be able to be produced cost-effectively and, if need be, enable an electrical contact between the built-in part and contacting points located on the glass pane for electrical arrangements or components integrated into the glass pane or connected therewith.

The solution to this problem is the subject-matter of claim 1. Advantageous developments are given in sub-claims 2-28.

SUMMARY

The retaining socket according to the invention for the detachable fixing of a built-in part to a glass pane has a base part and at least two accommodation spaces for assigned retaining portions of the built-in part fixed detachably thereto, wherein the first accommodation space is arranged for the accommodation of a retaining portion of the built-in part introduceable in the direction of movement perpendicular to the base part and the second accommodation space for the accommodation of a retaining portion of the built-in part introduceable in the direction of movement parallel to the base part.

In a first embodiment the base part is used for the fixing, in particular gluing, of the retaining socket to the glass pane. The description below mainly refers to this first embodiment. It is in many respects however also readable onto a more general aspect of the invention, wherein the base part primarily serves to provide a reference plane and support function common to both accommodation spaces and wherein the retaining socket may alternatively be attached to the glass pane via side walls and/or side supports such as described and explained herein later.

The provision of the two different accommodation spaces makes it possible to use the same retaining socket for different fixing directions when fitting a built-in part. An individual retaining socket needs to have only comparatively small dimensions, since a number of retaining sockets can be disposed spaced apart from one another on the glass pane for the fixing of built-in parts with larger dimensions, whereby a retaining socket is assigned respectively to a retaining portion of the built-in part.

The accommodation spaces are designed in such a way that a suitably shaped retaining portion can be accommodated therein and fixed detachably therein in the intended retention position. The fixing means assigned to an accommodation space can be disposed in the respective accommodation space or outside the latter. The accommodation spaces normally comprise guide elements such as rails or walls, so that the introduced retaining portion can be guided into the retention position according to the intended direction of movement and held therein.

In order to achieve the aim of universal usability of the retaining socket according to invention, the first accommodation space is preferably constructed tank-shaped or channel-shaped, i.e. is open at the top viewed from the glass pane and thus permits the introduction of the corresponding retaining portion from above, i.e. essentially perpendicular to the glass pane. The second accommodation space, on the other hand, is preferably constructed tunnel-shaped or bridge-shaped, i.e. it has at all events a cover bar facing away from the glass pane, which prevents a retaining portion of the built-in part introduced into this accommodation space from moving away from the glass pane and thus mechanically secures the latter in the direction of movement perpendicular to the glass pane.

More generally the first accommodation space permits the introduction of the corresponding retaining portion essentially perpendicular to the base part which may be arranged parallel or perpendicular to the glass pane whereas the second accommodation space is preferably constructed tunnel-shaped or bridge-shaped, i.e. it has at all events a cover bar facing away from the base part, which prevents a retaining portion of the built-in part introduced into this accommodation space from moving away perpendicular to the base part and thus mechanically secures the latter to the glass pane.

The retaining socket preferably has at least two side walls disposed on the base part and—in its first embodiment—on its side facing away from the glass pane which run perpendicular to said base part (and optionally the glass pane), said side walls enclosing between them the first accommodation space. The side walls at least partially enclose between them the assigned retaining portion of the built-in part introduced into the first accommodation space. The retaining portion of the built-in part can be designed higher or lower than the side walls. It can in particular also continue beyond the first accommodation space, so that the side walls and in particular their upper edges are enclosed on both sides at least in zones by the retaining portion.

As a rule, there is provided in the region of the side walls at least one fixing element, with which the retaining portion of the built-in part can be fixed in the first accommodation space after its introduction, i.e. secured against undesirable detachment or displacement especially opposite to the direction of movement during introduction after the retention position has been reached. The fixing element can preferably comprise at least one lock-in ridge running parallel to the base part. Lock-in ridge means an extended protrusion of at least one of the side walls, which either engages in an assigned recess of the retaining portion or grips over the retaining portion after the retention position has been reached. It goes without saying that, by means of suitable dimensioning and material selection of the side walls, it must be ensured, in case of need, that the latter can first be caused to give way by deformation when the retaining portion is introduced and finally return into a lock-in position fixing the retaining portion. Furthermore, it goes without saying that, in a reversal of the arrangement, a lock-in ridge can also be designed as a notch or groove in a side wall, into which an extended protrusion disposed in the retaining portion can engage.

If such lock-in ridges are provided in the area of the side walls, this also facilitates pushing-in of a retaining portion of the built-in part parallel to the glass pane or more generally to the base part, into the first accommodation space as a further variant of the fixing of a built-in part with the aid of the retaining socket according to the invention. With this third fixing variant, the lock-in ridges act as guide rails for the retaining portion.

The introduction of a retaining portion of the built-in part to be fixed into the first accommodation space is facilitated if the upper edges of the side walls facing away from the base part are bevelled in the manner of a funnel at least in zones, so that the retaining portion is centred or guided in the direction of the first accommodation space.

The removal of the built-in part, e.g. for repair purposes, takes place by releasing the lock-in connection, for which purpose suitable tools can be used in a known manner. Alternatively, or additionally, the retaining socket can be equipped if need be with auxiliary means, with which the removal of the built-in part is facilitated.

Especially when it is intended to produce, in the area of the retaining socket according to the invention, an electrical connection between the built-in part to be fixed and an electrical arrangement on the glass-pane side, it is preferable for, e.g., the base part to have at least one through-hole disposed between the side walls, which through-hole enables a direct contact of the built-in part fixed in the retaining socket or more precisely contacts disposed thereon, especially spring contacts, with the glass pane or contacting points located thereon. In the usual case, the through-hole extending at right angles to the base part or to the glass pane is surrounded all round by the base part, in particular for stability reasons. It lies within the scope of the invention, however, to leave open the base part, especially in the region of one of the end faces of the first accommodation space bounded by the side walls, and thus to form a through-hole open at least on one side in the plane of the base part. This can facilitate the pushing-in of a retaining portion of the built-in part, especially when electrical contacts are provided at its lower side.

The base part serves, amongst other things, as a support for the elements of the retaining socket according to the invention that form the two accommodation spaces. Its lower side, if facing the glass pane in the installed state, is shaped flat or, if need be, curved according to the shape of the glass pane. The base part can be fixed to the glass pane with its underside in various ways, for example by soldering or friction welding, but especially by an adhesive joint. In the simplest form of embodiment, a part of or the whole of the underside of the base part serves as an adhesion surface, onto which a thin layer of a suitable adhesive is deposited prior to the fixing-on (pressing-on) of the retaining socket onto the glass pane. It is preferable for the base part to comprise separate adhesion flanges adjacent to the side walls, by means of which the retaining socket is glued to the glass pane. Instead of an adhesive joint, a soldered joint or the like can also be made in the region of the adhesion flange.

Instead of an adhesive joint or soldering with adhesive or solder applied over the surface, it is also possible to work with adhesive deposits or solder deposits in adhesive chambers open to the bottom in the underside of the base part and in particular in the adhesion flanges.

In an alternative arrangement the retaining socket may be affixed to the glass panes via other surfaces, e.g., via its side walls, which in this case need then to be configured such as described before in the context of the base part.

According to a particularly preferred form of embodiment, the retaining socket according to the invention comprises at least one bridge, which together with the base part or (in the installed state of the first embodiment) with the glass pane forms the second, tunnel-like accommodation space, the bridge following on, especially in the longitudinal direction of the side walls, directly from the latter or with a spacing.

As in the case of the first accommodation space, it is preferable for the second accommodation space if there is provided in the region of the bridge at least one fixing element, with which a retaining portion of the built-in part can be fixed in the second accommodation space, so that undesired detachment or displacement of the retaining portion of the built-in part introduced therein is prevented after the retention position has been reached.

According to a preferred form of embodiment, the fixing element comprises at least one lock-in ridge along the cover bar and/or one of the side supports (as a rule disposed perpendicular to the base part or the glass pane) of the bridge.

Corresponding to the first accommodation space, the outer edges of the bridge that face away from the side walls and from which the introduction of a retaining portion takes place into the second accommodation space, are preferably bevelled in a funnel-like manner at least in zones, so that the retaining portion is centred or guided in the direction of the second accommodation space.

According to a further form of embodiment, the retaining socket comprises at least one magnetic guidance or fixing element, which can be disposed for example in the region of one of the accommodation spaces. There can be assigned to this magnetic guidance or fixing element at least one corresponding magnet or one ferromagnetic counterpart in the region of the retaining portion of the built-in part to be fixed thereto, so that the retaining portion is either guided by magnetic repulsion during the introduction into the respective accommodation space of the retaining socket or—in the case of opposite-pole magnets—is drawn into the retaining socket by magnetic attraction and is fixed in the retention position. This variant of the invention can facilitate and make more reliable the fixing of the built-in part at the intended place and in the desired orientation.

The invention also relates to a glass pane, in particular an automotive glass pane, with at least one retaining socket according to the invention fixed to the latter. An individual retaining socket will as a rule suffice to fix smaller built-in parts to the glass pane, for example electrical plug-in connectors. For larger built-in parts such as brake lights, antennas, antenna amplifiers or the like, at least two of the retaining sockets according to the invention will as a rule be used, the universality of the retaining socket taking effect especially when one of the retaining portions is introduced parallel to the base part (to the glass pane) into the corresponding accommodation space of the assigned retaining socket and another is introduced perpendicular to the base part (to the glass pane) into the other accommodation space of a retaining socket of the same design. Especially when built-in parts having spring contacts are fixed in the retaining socket, it is recommendable to provide the spring contacts where a retaining portion is introduced into a tunnel-like second accommodation space. In this way, the elastic forces exerted by the spring contacts are absorbed most reliably and durably by the respective retaining socket.

A particularly preferred application of the invention is an arrangement consisting of a glass pane and at least one retaining socket; wherein a retaining socket comprises a through-hole, e.g. in its base part, in which is disposed at least one contacting point of an electrical arrangement on the glass pane, the built-in part comprising at least one spring contact assigned to this contacting point.

The retaining socket according to the invention can be produced from a large variety of materials. Not only from the cost standpoint is it particularly preferably made from plastic. It can be produced in particular as a one-piece component, in particular by injection moulding. The plastic should have a thermal expansion coefficient that does not differ too far from that of the glass pane, in order to avoid a thermally induced detachment of the retaining socket from the glass pane. At the time of the invention, glass-fibre reinforced polybutylene terephthalate (PBT) with a glass fibre proportion of up to approx. 50 vol. % (PBT GF 50) is regarded as a particularly suitable material. Instead of plastics, or combined with the latter, metals, such as for example magnesium or its alloys, or other materials can be used for the production of the retaining socket according to the invention, especially metals mouldable in the casting process.

"Glass panes" comprise both single panes as well as multiple glazing units containing a number of individual panes, such as laminated glass panes or insulating glass panes, wherein the individual panes can be made from inorganic glass or also from transparent plastics. It goes without saying that the invention can also be employed when, instead of glass panes in the literal sense, sheet-like substrates of other materials are used.

Insofar as terms such as "parallel" and "perpendicular" are used in the claims and the description for directions of movement or relative arrangements, they are also intended to comprise oblique or curved or combined directions of movement or relative arrangements, as long as the direction of movement or relative arrangement does not deviate overall by more than approx. 30° from the mathematically exact direction or relative arrangement.

BRIEF DESCRIPTION OF THE DRAWINGS

The invention will be explained in greater detail below with the aid of a graphic representation. The figures show the following.

All the figures are diagrammatic views which are not to scale. Identical reference numbers designate identical parts.

DETAILED DESCRIPTION OF PREFERRED EMBODIMENTS

Figure 1:
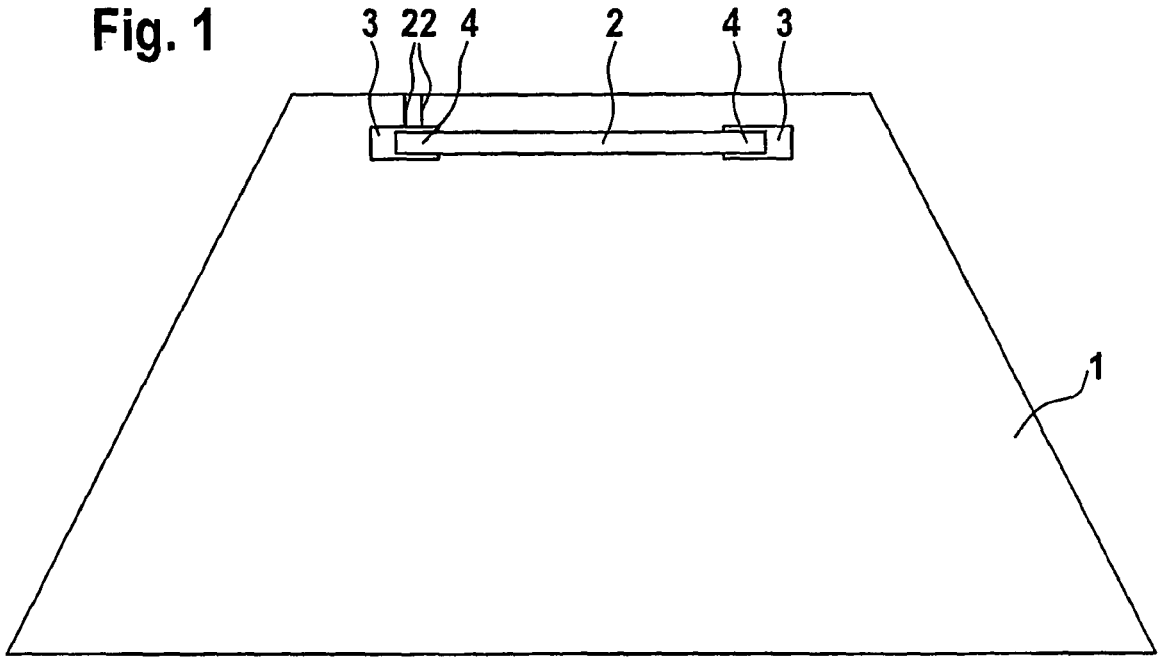
FIG. 1 an automotive glass pane with two retaining sockets and a built-in part fixed thereto, FIG. 2 a first embodiment of a retaining socket according to the invention in perspective view, FIG. 3 a second embodiment of a retaining socket according to the invention in perspective view, FIG. 4 a retaining socket on a glass pane in side view with three retaining portions of built-in parts introduceable in different directions of movement.

A trapezoidal glass pane 1, i.e. an automotive glass pane such as for example a backlight or windscreen, is shown diagrammatically in FIG. 1. Two retaining sockets 3 are fixed to glass pane 1 close to its upper pane edge, to which retaining sockets 3 a built-in part 2 is fixed detachably with retaining portions 4. Built-in part 2 could for example be a brake light, a rain sensor, an antenna or an antenna amplifier. In the region of left-hand retaining socket 3, there can be seen two supply lines 22, which lead to this retaining socket 3 and end in terminal faces (not shown in the general drawing of FIG. 1) beneath retaining socket 3. Built-in part 2 is supplied, for example, with energy via these supply lines 22 after the fixing in retaining sockets 3 or signals are routed from built-in part 2 to a receiver on the vehicle side or from a transmitter on the vehicle side into built-in part 2.

Figure 2:
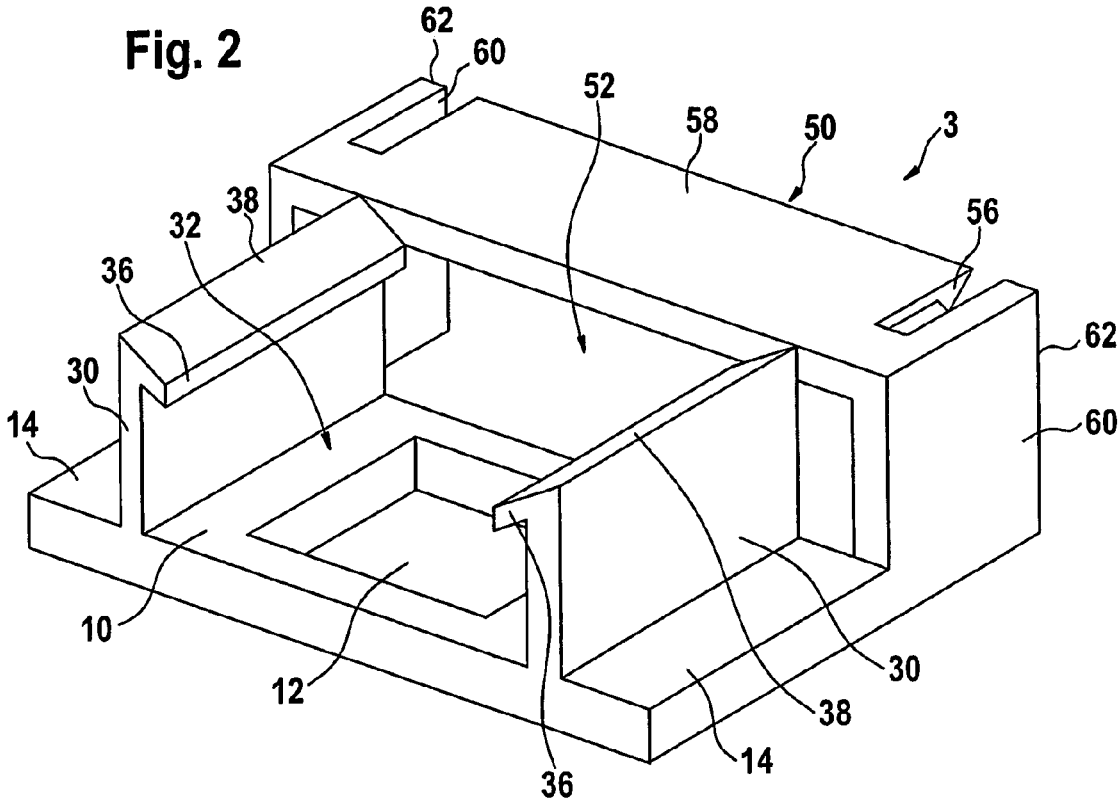
Figure 3:
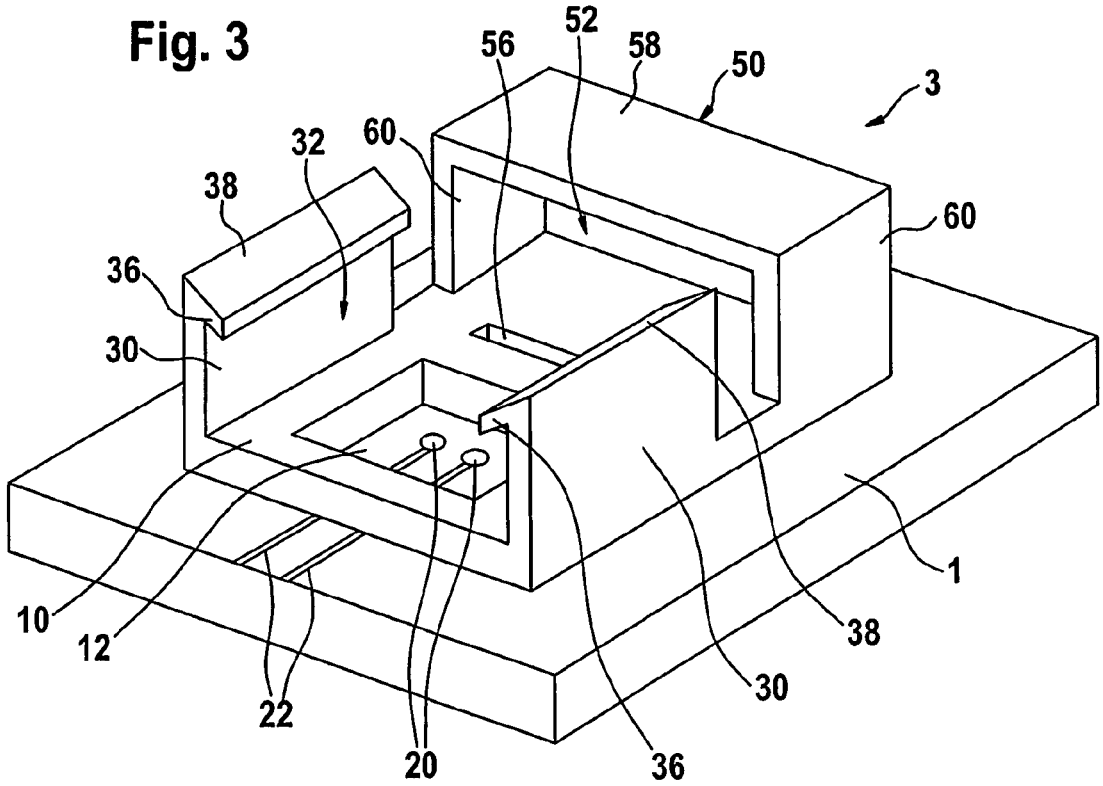

Two embodiments of retaining socket 3 according to the invention are shown in FIGS. 2 and 3. Retaining socket 3 has a two-dimensionally extending base part 10, the underside whereof is intended for fixing to a glass pane 1 not shown here. Disposed on base part 10 and perpendicular thereto are two side walls 30 spaced apart from one another, which between them enclose a first accommodation space 32 for accommodating a retaining portion 4 (not shown here) of a built-in part 2. First accommodation space 32 is open to the top, so that retaining portion 4 can be introduced into it perpendicular to base part 10 and parallel to side walls 30. Base part 10 has between side walls 30 a through-hole 12 extending perpendicular to base part 10, via which through-hole 12 direct contact can be made between retaining portion 4 of built-in part 2 and glass pane 1 or contacting points 20 located thereon.

In the region of through-hole 12, there can be seen in FIG. 3 two contacting points 20 of an electrical arrangement located on the surface of glass pane 1, to which contacting points supply lines 22 lead.

Upper edges 38 of side walls 30 are bevelled in the manner of a funnel, which makes it easier to introduce into first accommodation space 32 a retaining portion 4 of built-in part 2 to be fixed in retaining socket 3. Upper edges 38 are at the same time designed as fixing elements 36 in the form of lock-in ridges, which ensure fixing of built-in part 2 in the retention position. They could also serve as guide rails if, in another variant of the movement, a retaining portion 4 were pushed into first accommodation space 32 from the left parallel to base part 10 instead of from above.

In the case of the first embodiment according to FIG. 2, base part 10 comprises two adhesion flanges 14 which, viewed from first accommodation space 32, lie externally adjacent to side walls 30. Adhesion flanges 14 can be provided on their undersides with an adhesive, they can also comprise adhesive chambers open to the bottom, in which the adhesive is disposed with which retaining socket 3 is glued to glass pane 1. In the two embodiments according to FIG. 3, the whole underside of base part 10 or a part thereof forms the adhesion surface. As an alternative to or in addition to an adhesive joint, another kind of mechanical, permanent connection to glass pane 1 could also take place, e.g. by soldering, welding or the like, where, for example, solder deposits or suchlike can be provided instead of an adhesive.

In the longitudinal direction of side walls 30, there follows on from the latter second accommodation space 52, which lies beneath a bridge 50, which comprises two side supports 60 and a cover bar 58. In the case of the first embodiment according to FIG. 2, base part 10 ends before bridge 50, so that tunnel-like second accommodation space 52 is bounded all round by bridge 50 and—in the installed state—glass pane 1. In the second embodiment, base part 10 continues up to beneath bridge 50, so that in this case second accommodation space 52 is bounded all round by bridge 50 and base part 10.

The inside width of bridge 50 is greater than the distance between side walls 30 of first accommodation space 32 in the first embodiment (FIG. 2) and is equal to the latter in the second embodiment (FIG. 3). It could also be smaller. Similarly, the height and the length of the two accommodation spaces 32, 52 could in each case be equal to or different from one another. Tunnel-like second accommodation space 52 could also be designed as a through-hole in a transverse wall, which follows on from side walls 30 directly or with a spacing, said through-hole extending parallel to base part 10.

In the second form of embodiment according to FIG. 3, cover bar 58 of bridge 50 is designed as a continuous beam. At the same time, a fixing element 56 is assigned jointly to first accommodation space 32 and to second accommodation space 52, said fixing element 56 being formed as a recess (lock-in groove) in base part 10.

In the case of the first embodiment according to FIG. 2, cover bar 58 of bridge 50 has a middle segment, which is separated by oblong notches from its end zones. The middle segment of cover bar 58 is equipped with a fixing element 56 in the form of a lock-in ridge. Due to the provision of the notches, it is able to become elastically deformed more easily than without the notches during the insertion of assigned retaining portion 4 and can move back after the retention position has been reached with the lock-in ridge locking into an assigned lock-in groove in retaining portion 4.

Side supports 60 and cover bar 58 of bridge 50 serve to guide and hold a retaining portion 4 of built-in part 2 introduced parallel to base part 10 and glass pane 1 into second accommodation space 52 and at the same time stiffen retaining socket 3. Unlike the case of the two embodiments shown, outer edges 62 of the bridge could also be bevelled similar to outer edges 38 of the side walls, in order to facilitate the pushing-in of a retaining portion 4 beneath bridge 50. FIG. 2 shows bevelling of the middle part of cover bar 58 with the same purpose.

Figure 4:
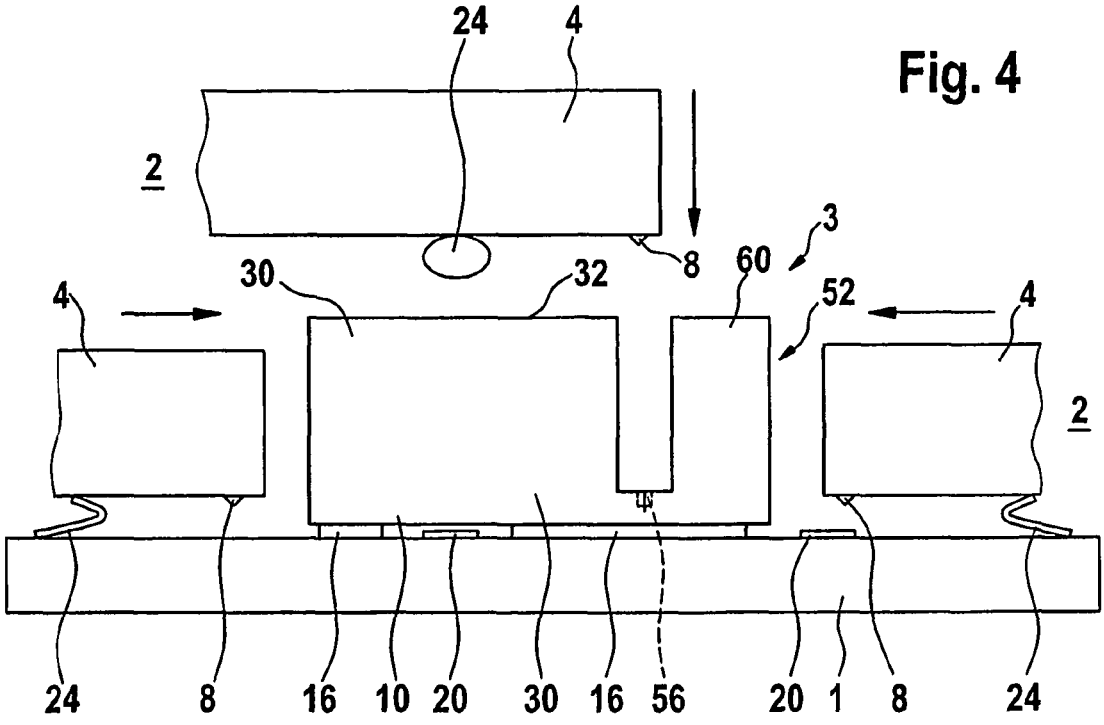

A retaining socket 3 according to FIGS. 2, 3 fixed to a glass pane 1 by means of an adhesive 16 is shown in side view in FIG. 4. Three movement variants are shown as to how a retaining portion 4 of a built-in part 2 can be introduced into retaining socket 3, i.e. parallel to glass pane 1 and to base part 10 from the left into first accommodation space 32, from above perpendicular to base part 10 into first accommodation space 32, and finally from the right parallel to glass pane 1 and to base part 10 into second accommodation space 52.

In all three variants, retaining portions 4 comprise at their undersides elastically deformable spring contacts 24, which can be designed either as metallic springs (left-hand and right-hand variants) or as compressible conductive plastic (middle variant, e.g. on a silicone base with a silver particle filling). These spring contacts 24 are disposed in such a way that, in the retention position of retaining portion 4, they each come into contact under pretension with an assigned contacting point 20 on the surface of glass pane 1, so that an electrically conductive connection arises between an electrical arrangement and built-in part 2. It goes without saying that capacitive contacts can also be used for HF elements such as antennas.

Retaining portions 4 each have on their underside a fixing means 8 designed as a locking lug, which is intended to lock into an assigned fixing means 56 (lock-in groove) of retaining socket 3 (see also FIG. 3) in the final retention position, so that an undesired movement parallel to glass pane 1 is prevented.

FIGS. 5-8 show four variants, wherein a built-in part 2 is fixed detachably to a glass pane 1 in each case by means of two retaining sockets 3 according to the invention. Built-in part 2 can for example be an oblong brake light.

Figure 5:
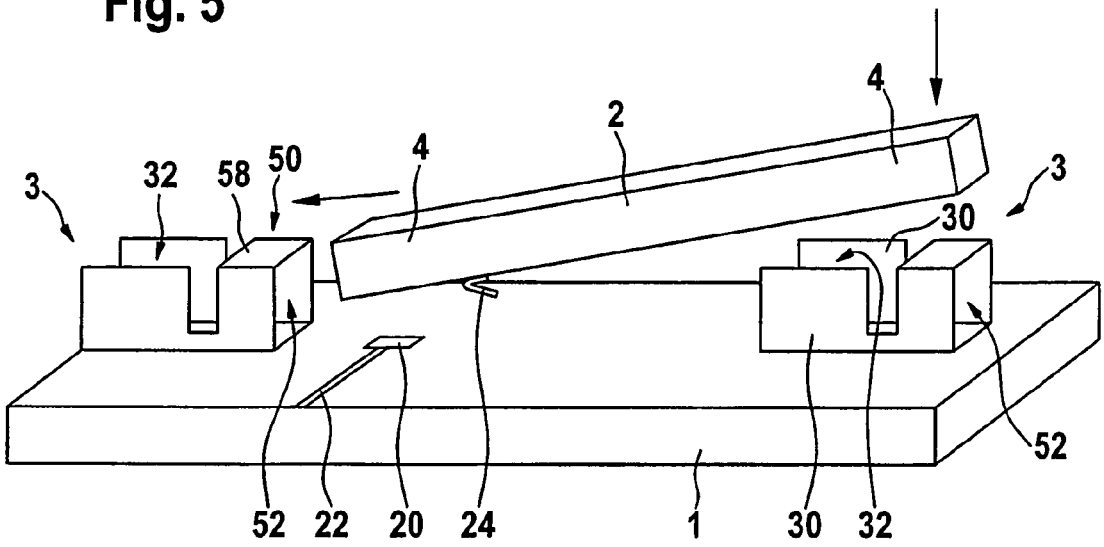
FIG. 5-8 four different arrangements of, in each case, two retaining sockets on a glass pane and built-in parts introduceable therein in different directions with their retaining portions.

According to FIG. 5, the two retaining sockets 3 are disposed aligned at a distance from one another and in identical orientation, such that first accommodation space 32 lies respectively on the left and second accommodation space 52 on the right. For the purpose of fixing, built-in part 2 is lowered over the two retaining sockets 3 and then introduced with its left-hand retaining portion 4 into tunnel-like second accommodation space 52 of left-hand retaining socket 3 and thereafter, or simultaneously, introduced with its right-hand retaining portion 4 into first accommodation space 32 of right-hand retaining socket 3. Built-in part 2 has at its lower side a spring contact 24 which, after fixing in retaining sockets 3, is in an electrically conductive connection with a contacting point 20, from which a supply line 22 proceeds, which leads to an electrical arrangement (not shown) on glass pane 1. The electrical contact location is disposed close to left-hand retaining socket 3, in order that cover bar 58 of bridge 50 of tunnel-like accommodation space 52 can absorb reliably and durably the permanently acting elastic force of spring contact 24 in the installed state.

Figure 6:
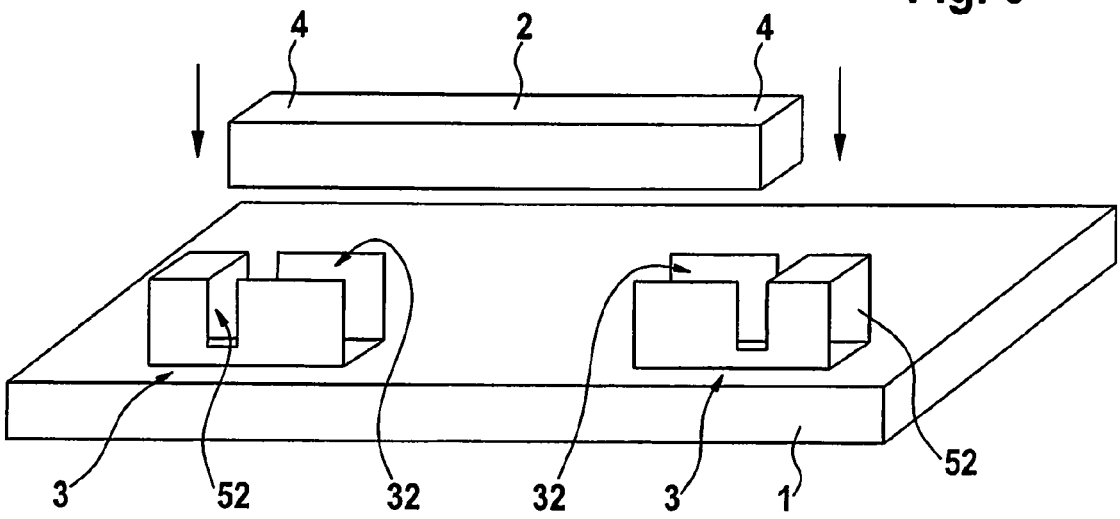

In the variant according to FIG. 6, retaining sockets 3 are disposed in such a way that their accommodation spaces 32 point towards one another. In this variant, built-in part 2 is introduced from above in the direction of movement perpendicular to glass pane 1 with its retaining portions 4 into accommodation spaces 32 of retaining sockets 3 and detachably fixed therein.

Figure 7:
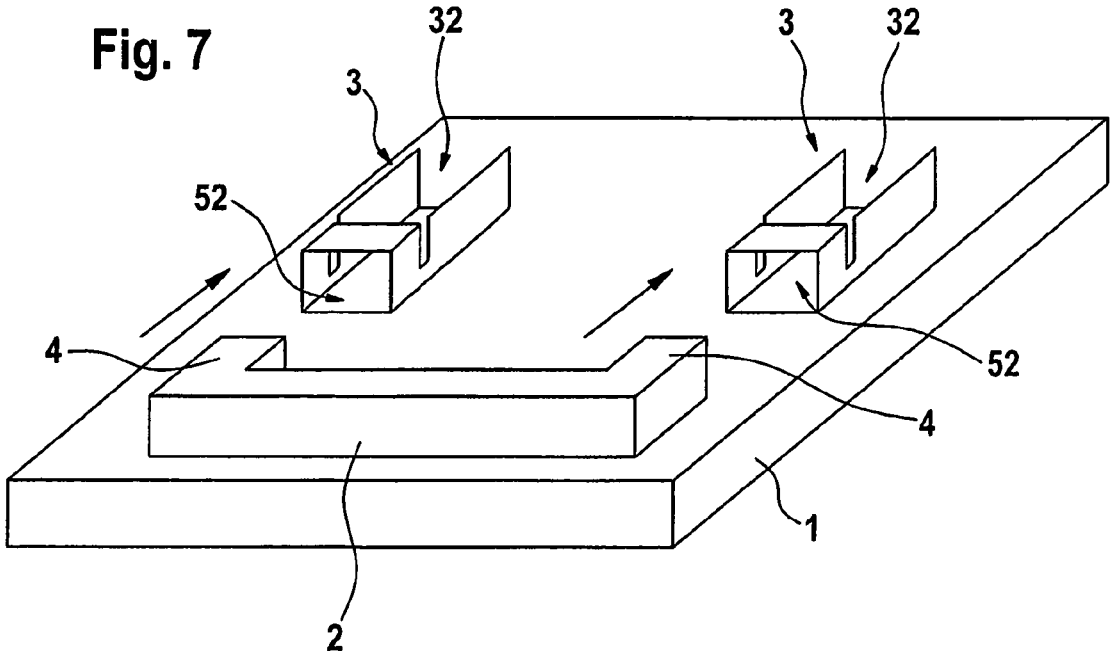
Figure 8:
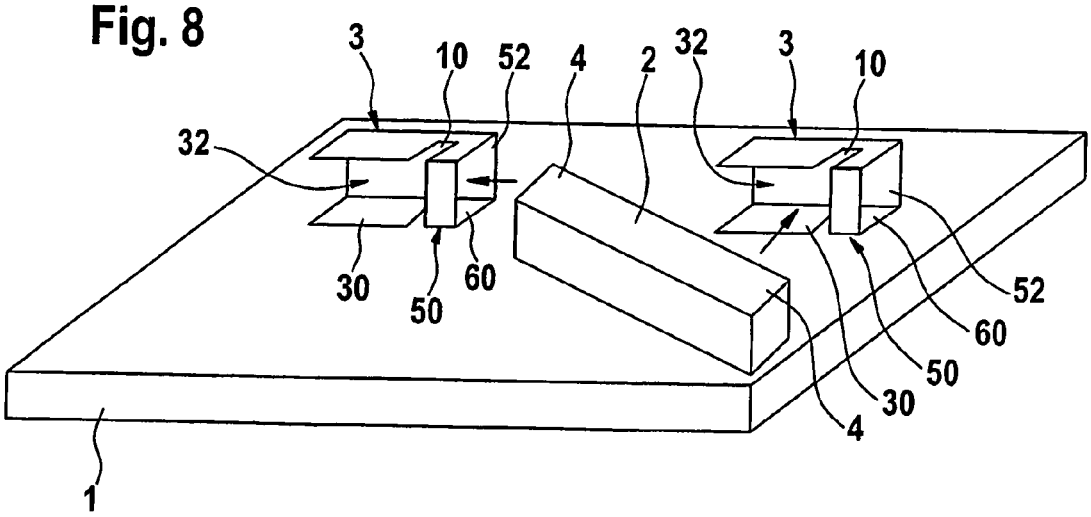

In the variant according to FIG. 7, U-shaped built-in part 2 has retaining portions 4 projecting at an angle. The two retaining sockets 3 are fixed parallel and at a distance from one another on glass pane 1, in such a way that accommodation spaces 52 each point forwards. In this case, built-in part 2 is moved from front to back for the fixing, whereby its retaining portions 4 slide into tunnel-like accommodation spaces 52 and are fixed detachably therein.

As shown in FIGS. 1 to 7, the base part 10 of the retaining socket 3 is fixed to a glass pane 1, for example by soldering or friction welding, but especially by an adhesive joint. However, as an alternative such as shown schematically in FIG. 8, the retaining socket 3 may instead be fixed to the glass pane 1 using a side wall 30 of the first accommodation space 32 and/or a side support 60 of the bridge 50. The side wall 30 and/or side support 60 may be fixed to the glass by, for example, soldering or friction welding, but especially by an adhesive joint. For the purposes of fixing, a built-in part 2 is lowered near to a first retaining socket 3, arranged on the left side of FIG. 8, and one retaining portion 4 introduced into the tunnel-like second accommodation space 52 of the first retaining socket 3. The second retaining portion 4 is then introduced, in a direction parallel to the surface of the glass pane 1, into the first accommodation space 32 of a second retaining socket 3, arranged on the right side of FIG. 8.

As shown in FIGS. 5 to 8, a built-in part 2 may be fixed detachably to a glass pane 1 using a first accommodation space 32 of one retaining socket 3 and a second accommodation space 52 of a second retaining socket 3. Each retaining socket 3 therefore has an unused accommodation space 52, 32. Further built-in parts may be fixed detachably to the glass pane 1 using these unused accommodation spaces 52, 32. In this manner, a retaining socket 3 can be used to link together two or more built-in parts.

The invention claimed is:

1. Glass pane with at least one retaining socket fixed thereto; the retaining socket being for the detachable fixing of a built-in part to said glass pane and comprising a) a base part, b) at least one first accommodation space for accommodating a retaining portion of a built-in part introduceable into the accommodation space in the direction of movement perpendicular to the base part, and c) at least one second accommodation space for accommodating a retaining portion of a separate built-in part introduceable in the direction of movement parallel to the base part.

2. Glass pane according to claim 1, wherein at least one magnetic guidance or fixing element is provided in the retaining socket, with which the introduction of the retaining portion into the assigned accommodation space is facilitated and/or which fixes the retaining portion therein.

3. Glass pane according to claim 1, wherein the base part is intended for the fixing, in particular gluing, of the retaining socket to the glass pane.

4. A glass pane with at least one retaining socket fixed thereto according to claim 3 and with a built-in part fixed detachably to this retaining socket.

5. The glass pane according to claim 4, wherein at least one retaining socket comprises a through-hole in its base part, in which through-hole there is disposed at least one contacting point of an electrical arrangement on the glass pane, and wherein the built-in part comprises at least one electrical contact, in particular a spring contact, detachably assigned to this contacting point.

6. Glass pane according to claim 3, wherein the retaining socket comprises at least two side walls disposed on the side of the base part facing away from the glass pane and running perpendicular to the base part, said side walls enclosing between them the first accommodation space.

7. Glass pane according to claim 6, wherein there is provided in the region of the side walls at least one fixing element, with which a retaining portion of the built-in part can be fixed in the first accommodation space.

8. Glass pane according to claim 7, wherein the fixing element comprises at least one lock-in ridge running parallel to the base part.

9. Glass pane according to claim 6, wherein the upper edges of the side walls facing away from the base part are bevelled in the manner of a funnel at least in zones.

10. Glass pane according to claim 6, wherein the base part has at least one through-hole disposed between the side walls, said through-hole enabling a direct contact of the built-in part fixed in the retaining socket with the glass pane.

11. Glass pane according to claim 10, wherein the through-hole is bounded all round by the base part.

12. Glass pane according to claim 6, wherein the base part comprises an adhesion flange adjacent to the side walls.

13. Glass pane according to claim 6, wherein the retaining socket comprises at least one bridge, which together with the base part or the glass pane forms a tunnel-like second accommodation space.

14. Glass pane according to claim 13, wherein the bridge follows on in the longitudinal direction of the side walls directly from the latter or with a spacing.

15. Glass pane according to claim 13, wherein, in the region of the bridge, there is provided at least one fixing element, with which a retaining portion of the built-in part can be fixed in the second accommodation space.

16. Glass pane according to claim 15, wherein the fixing element comprises at least one lock-in ridge along the cover bar and/or a side support of the bridge.

17. Glass pane according to claim 13, wherein the outer edges of the bridge facing away from the side walls are bevelled in the manner of a funnel at least in zones.

18. Glass pane according to claim 1, wherein the retaining socket comprises at least two side walls running perpendicular to the base part, said side walls enclosing between them the first accommodation space.

19. Glass pane according to claim 18, wherein there is provided in the region of the side walls at least one fixing element, with which a retaining portion of the built-in part can be fixed in the first accommodation space.

20. Glass pane according to claim 19, wherein the fixing element comprises at least one lock-in ridge running parallel to the base part.

21. Glass pane according to claim 18, wherein the upper edges of the side walls facing away from the base part are bevelled in the manner of a funnel at least in zones.

22. Glass pane according to claim 18, wherein the retaining socket comprises at least one bridge, which together with the base part or the glass pane forms a tunnel-like second accommodation space.

23. Glass pane according to claim 22, wherein the bridge follows on in the longitudinal direction of the side walls directly from the latter or with a spacing.

24. Glass pane according to claim 22, wherein, in the region of the bridge, there is provided at least one fixing element, with which a retaining portion of the built-in part can be fixed in the second accommodation space.

25. Glass pane according to claim 24, wherein the fixing element comprises at least one lock-in ridge along the cover bar and/or a side support of the bridge.

26. Glass pane according to claim 22, wherein the outer edges of the bridge facing away from the side walls are bevelled in the manner of a funnel at least in zones.

27. Glass pane according to claim 18, wherein at least one magnetic guidance or fixing element is provided in the retaining socket, with which the introduction of the retaining portion into the assigned accommodation space is facilitated and/or which fixes the retaining portion therein.

28. A glass pane with at least one retaining socket fixed thereto according to claim 18 and with a built-in part fixed detachably to this retaining socket.

* * * * *